US005451013A

United States Patent [19]

Schutz

[11] Patent Number: 5,451,013

[45] Date of Patent: Sep. 19, 1995

[54] APPARATUS AND METHOD FOR MOUNTING A PAPER ROLL PRODUCT WITH CORE ON A CORELESS PAPER ROLL SPINDLE

[75] Inventor: Rudolph W. Schutz, Walnut Creek, Calif.

[73] Assignee: James River Paper Company, Inc., Richmond, Va.

[21] Appl. No.: 317,317

[22] Filed: Oct. 4, 1994

[51] Int. Cl.[6] ..... B65H 16/04

[52] U.S. Cl. ..... 242/597.4; 242/597.5

[58] Field of Search ..... 242/597–597.8

[56] References Cited

U.S. PATENT DOCUMENTS

| | | | |
|---|---|---|---|
| D. 324,618 | 3/1992 | Morand . | |
| 1,069,961 | 8/1913 | Kuczynski | 242/597.4 |
| 2,641,415 | 6/1953 | Moriarty | 242/597.4 X |
| 2,707,594 | 5/1955 | Moore . | |
| 2,862,677 | 12/1958 | Selsted | 242/597.4 |
| 2,928,618 | 3/1960 | Locke | 242/597.4 X |
| 3,484,052 | 12/1969 | Clarke | 242/597.3 X |
| 3,593,936 | 7/1971 | Davis . | |
| 3,656,700 | 4/1972 | Gauvin | 242/597.7 X |
| 3,672,591 | 6/1972 | Davis . | |
| 3,753,531 | 8/1973 | Katoh | 242/597.6 |
| 3,923,265 | 12/1975 | Krueger et al. . | |
| 4,248,391 | 2/1981 | Ness . | |
| 5,370,339 | 12/1994 | Moody | 242/597.6 |

*Primary Examiner*—John M. Jillions
*Attorney, Agent, or Firm*—Thomas R. Lampe

[57] ABSTRACT

An apparatus and method for rotatably mounting a paper roll product having a central core defining a passageway on a coreless paper roll spindle. The apparatus includes a doubled-ended, elongated adapter spindle of readily deformable material defining a cavity for receiving the coreless paper roll spindle. A projection is affixed to the adapter spindle to restrict axial movement of a paper roll product mounted on the apparatus.

8 Claims, 1 Drawing Sheet

APPARATUS AND METHOD FOR MOUNTING A PAPER ROLL PRODUCT WITH CORE ON A CORELESS PAPER ROLL SPINDLE

TECHNICAL FIELD

This invention relates to an apparatus and a method for mounting a paper roll product comprising a paper web wrapped about a central core on a coreless paper roll spindle having a spindle body and an enlargement on the spindle body.

BACKGROUND ART

U.S. patent application Ser. No. 08/159,535, filed Dec. 1, 1993, now U.S. Pat. No. 5,370,339 discloses apparatus for dispensing web material from a coreless roll of such material.

Most conventional rolls of consumer paper products, such as toilet tissue, are not coreless in nature, instead comprising a paper web wrapped about a central core of paperboard or the like. The coreless paper roll dispenser apparatus disclosed in the above-identified application is not suitable for use with the more conventional paper roll product utilizing a core. The paper roll product with a core will not be mounted on a stable fashion on the apparatus.

A search directed to the invention of the present application located the following United States patents, which are believed to be representative of the current state of the prior art in this field: U.S. Pat. No. 4,248,391, issued Feb. 3, 1981, U.S. Pat. No. 3,923,265, issued Dec. 2, 1975, U.S. Pat. No. 3,672,591, issued Jun. 27, 1972, U.S. Pat. No. 3,593,936, issued Jul. 20, 1971, U.S. Pat. No. 2,707,594, issued May 3, 1955, and U.S. Pat. No. Des. 324,618, issued Mar. 17, 1992.

The above, identified patents do not address the problem discussed above and which is solved by the present invention.

DISCLOSURE OF INVENTION

The apparatus of the present invention is for rotatably mounting a paper roll product comprising a paper web wrapped about a central core defining a passageway of uniform circular cross-sectional configuration of a predetermined magnitude along the length thereof on a coreless paper roll spindle having a spindle body and an enlargement on the spindle body.

The coreless paper roll spindle has a maximum cross-sectional configuration transverse to the primary axis of the coreless paper roll spindle substantially smaller in magnitude than the predetermined magnitude.

The apparatus includes a double ended elongated adapter spindle member at least partially formed of readily deformable material, the readily deformable material defining a cavity extending from an open first end of the elongated adapter spindle member for receiving and accommodating therein a coreless paper roll spindle with the coreless paper roll spindle being frictionally engaged by the elongated adapter spindle member to retain the apparatus on the coreless paper roll spindle.

The apparatus further includes a projection affixed to the elongated adapter spindle member at a location spaced from the open first end of the elongated adapter spindle member and projecting outwardly from the elongated adapter spindle member beyond the core of a paper roll product mounted on the elongated adapter spindle member and engageable by an end of the paper roll product to limit axial movement of the paper roll product relative to the apparatus and a coreless paper roll spindle within the cavity of the adapter spindle member.

The present invention also encompasses a method of rotatably mounting a paper roll product comprising a paper web wrapped about a central core defining a passageway of uniform circular cross-sectional configuration of a predetermined magnitude along the length thereof on a coreless paper roll spindle having a distal end, the coreless paper roll spindle having a maximum cross-sectional configuration transverse to the primary axis of the coreless paper roll spindle substantially smaller in magnitude than the predetermined magnitude.

Other features, advantages, and objects of the present invention will become apparent with reference to the following description and accompanying drawings.

BEST MODE FOR CARRYING OUT THE INVENTION

Figure 1:
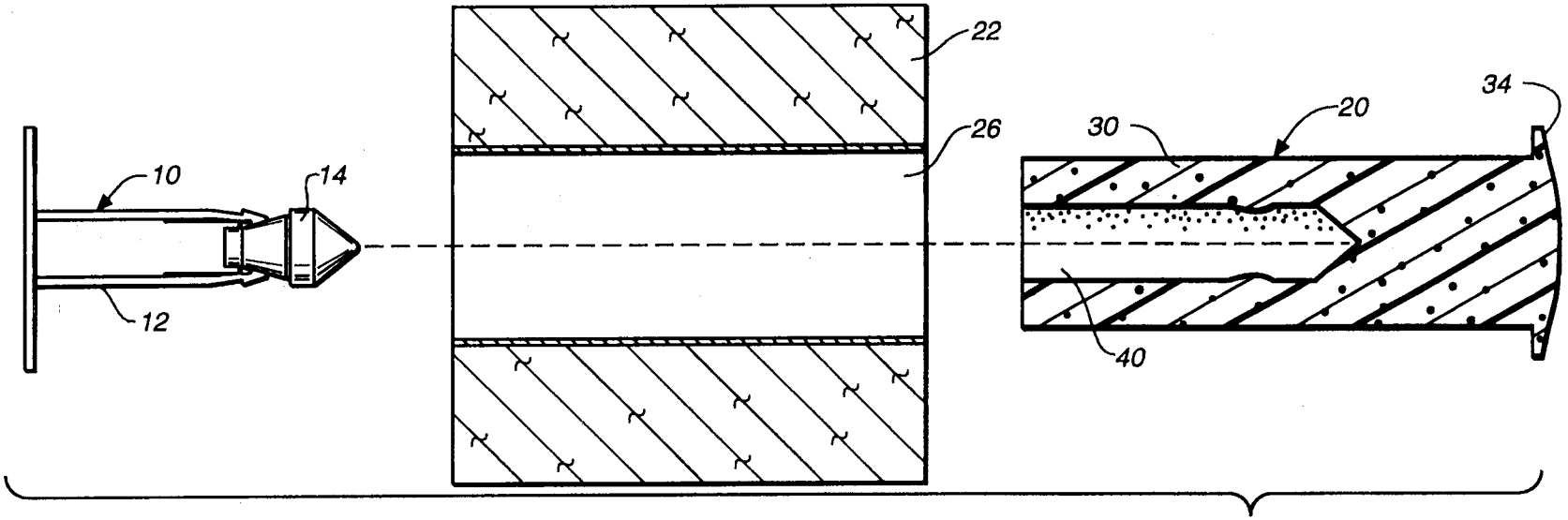
FIG. 1 is an exploded view of apparatus constructed in accordance with the teachings of the present invention illustrated in cross-section just prior to installation of the apparatus and a paper roll product with central core onto a coreless paper roll spindle.

Referring now to the drawings, reference numeral 10 designates a coreless paper roll spindle or mounting apparatus of the type disclosed in co-pending U.S. patent application Ser. No. 08/159,535, filed Dec. 1, 1993, now U.S. Pat. No. 5,370,339. In the interest of simplicity, spindle 10 will not be described in detail. Suffice it to say that coreless paper roll spindle 10 has a spindle body 12 and an enlargement 14 located at an end of the spindle body 12.

The apparatus of the present invention is designated by reference numeral 20 and such apparatus is for the purpose for rotatably mounting a paper roll product having a core on the coreless paper roll spindle 10. The disclosed paper roll product is a conventional roll of toilet tissue 22 comprising a tissue web wrapped about a central core 26 of paperboard or the like.

It is to be noted that the central aperture or passageway defined by core 26 is significantly larger than the outer peripheral surface of the coreless paper roll spindle 10. Therefore, the coreless paper roll spindle would be completely inappropriate for rotatably mounting the conventional roll with a core. The passageway defined by the central core 26 is, as is conventional, of uniform circular cross-sectional configuration of a predetermined magnitude along the length thereof. The coreless paper roll spindle 10 has a maximum cross-sectional configuration transverse to the primary axis thereof substantially smaller in magnitude than the predetermined magnitude.

Apparatus 20 comprises or includes a doubled-ended, elongated adapter spindle member 30 formed of readily deformable material. Preferably the material is soft and resilient, examples being foam rubber, soft rubber, sponge rubber or other suitable natural or synthetic materials. A material such as styrofoam or other synthetic foam type product of comparable nature could also be employed. The illustrated apparatus is of integral, unitary molded construction.

Apparatus 20 also includes a projection having a flange-like configuration affixed to the elongated adapter spindle member. In the arrangement illustrated, projection 34 is integral with the elongated adapter spindle member 20 and is disposed at one end of the elongated adapter spindle member.

Figure 2:
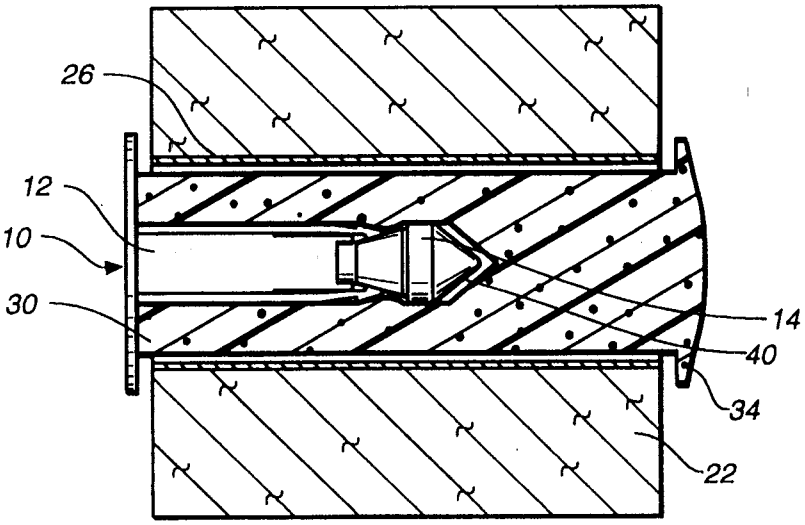
FIG. 2 is a cross-sectional view showing the apparatus and paper roll product, both in cross-section, installed on the coreless paper roll spindle.

It is to be noted that projection 34 radiates outwardly from the spindle member 30 a distance which makes the projection larger than the ends of core 26. Thus, a paper roll product mounted on the adapter spindle member 30 (as shown in FIG. 2) will abut the projection and have the axial movement of the paper roll product restricted. In the arrangement illustrated, the adapter spindle member has an outer cylindrically-shaped surface with a uniform circular cross-sectional configuration along the length thereof smaller than the uniform circular cross-sectional configuration of the paper roll product central core.

A cavity 40 extends from an open end of the elongated adapter spindle member for receiving and accommodating therein coreless paper roll spindle 10 with the coreless paper roll spindle being frictionally engaged by the elongated adapter spindle member to retain the apparatus on the coreless paper roll spindle.

Cavity 40 has a configuration generally corresponding to but smaller than the outer configuration of the spindle body 12 and enlargement 14 of the coreless paper roll spindle 10 whereby a relatively tight friction fit is formed between the adapter spindle member and the coreless paper roll spindle 10 received in cavity 40.

When installing the toilet tissue roll 22 in position on the coreless paper roll spindle, the operator first places the adapter spindle member within the central core passageway of the roll paper product. The elongated adapter spindle member is inserted completely through the central core passageway so that the open first end leading to cavity 40 is on one side of the paper roll product and the projection or flange 34 is on the other side thereof.

The elongated adapter spindle member is axially aligned with the coreless paper roll spindle with the open end of the elongated adapter spindle member directed toward the coreless paper roll spindle.

The distal end of the coreless paper roll spindle is inserted within the open end of the elongated adapter spindle member and slid into cavity 40 while deforming the material of the adapter spindle member.

A friction fit is thus established between the readily deformable material and the coreless paper roll spindle to retain the elongated adapter spindle member and paper roll product on the coreless paper roll spindle. The projection 34 restricts axial movement of the paper roll product relative to the elongated adapter spindle member and the coreless paper roll spindle while allowing rotation of the paper roll product.

I claim:

1. Apparatus for rotatably mounting a paper roll product comprising a paper web wrapped about a central core defining a passageway of uniform circular cross-sectional configuration of a predetermined magnitude along the length thereof on a coreless paper roll spindle having a spindle body and an enlargement on the spindle body, said coreless paper roll spindle having a maximum cross-sectional configuration transverse to the primary axis of the coreless paper roll spindle substantially smaller in magnitude than said predetermined magnitude, said apparatus comprising a double-ended, elongated, adapter spindle member at least partially formed of readily deformable material, said readily deformable material defining a cavity extending from an open first end of the elongated adapter spindle member for receiving and accommodating therein a coreless paper roll spindle with the coreless paper roll spindle being frictionally engaged by said elongated adapter spindle member to retain the apparatus on said coreless paper roll spindle, and a projection affixed to the elongated adapter spindle member at a location spaced from the open first end of the elongated adapter spindle member and projecting outwardly from the elongated adapter spindle member to extend beyond the core of a paper roll product mounted on the elongated adapter spindle member and engageable by an end of the paper roll product to limit axial movement of the paper roll product relative to said apparatus and relative to a coreless paper roll spindle within the cavity of said adapter spindle member.

2. The apparatus according to claim 1 wherein said adapter spindle member and said projection are of integral, unitary, molded construction.

3. The apparatus according to claim 1 wherein said adapter spindle member is wholly comprised of readily deformable material.

4. The apparatus according to claim 3 wherein said readily deformable material is soft, synthetic material.

5. The apparatus according to claim 1 wherein said cavity has a configuration generally corresponding to but smaller than the outer configuration of said spindle body and enlargement of the coreless paper roll spindle whereby a friction fit is formed between said adapter spindle member and a coreless paper roll spindle in said cavity.

6. The apparatus according to claim 1 wherein said adapter spindle member has an outer cylindrically-shaped surface with a uniform circular cross-sectional configuration along the length thereof smaller than the uniform circular cross-sectional configuration of said paper roll product central core.

7. The apparatus according to claim 3 wherein said readily deformable material is a plastic foam material.

8. A method of rotatably mounting a paper roll product comprising a paper web wrapped about a central core defining a passageway of uniform circular cross-sectional configuration of a predetermined magnitude along the length thereof on a coreless paper roll spindle having a distal end, said coreless paper roll spindle having a maximum cross-sectional configuration transverse to the primary axis of the coreless paper roll spindle substantially smaller in magnitude than said predetermined magnitude, said method comprising the steps of:

placing a double-ended, elongated adapter spindle member within the central core passageway of a paper roll product, said elongated adapter spindle member at least partially formed of readily deformable material which defines a cavity extending from an open first end of the elongated adapter spindle member;

inserting the elongated adapter spindle member completely through the central core passageway so that said open first end is on one side of the paper roll product and a second end of the elongated adapter spindle member projects from the other side of the paper roll product, said elongated adapter spindle member having a projection affixed thereto at a location spaced from said open first end which projects outwardly from the elongated adapter spindle member to extend beyond the central core;

axially aligning said elongated adapter spindle member with said coreless paper roll spindle with the open first end of said elongated adapter spindle member directed toward the coreless paper roll spindle;

inserting the distal end of the coreless paper roll spindle within the open first end of the elongated adapter spindle member;

sliding said coreless paper roll spindle into said cavity while deforming said readily deformable material with said coreless paper roll spindle;

establishing a friction fit between said readily deformable material and said coreless paper roll spindle to retain said elongated adapter spindle member and paper roll product on said coreless paper roll spindle; and employing said projection to restrict axial movement of said paper roll product relative to said elongated adapter spindle member and said coreless paper roll spindle while allowing rotation of said paper roll product.

* * * * *